US007588222B1

(12) United States Patent
Feldberg

(10) Patent No.: US 7,588,222 B1
(45) Date of Patent: Sep. 15, 2009

(54) MOUNTING BRACKET ASSEMBLY

(76) Inventor: Michael L. Feldberg, 9205 30th Ave. N., New Hope, MN (US) 55427

( * ) Notice: Subject to any disclaimer, the term of this patent is extended or adjusted under 35 U.S.C. 154(b) by 280 days.

(21) Appl. No.: 11/412,682

(22) Filed: Apr. 27, 2006

(51) Int. Cl.
*A47B 96/06* (2006.01)
*A47G 29/00* (2006.01)
*E04G 3/00* (2006.01)
*E04G 5/06* (2006.01)

(52) U.S. Cl. ..... 248/218.4; 248/220.21

(58) Field of Classification Search ..... 248/214, 248/218.4, 219.4, 220.21, 219.3, 230.1, 230.5, 248/231.9
See application file for complete search history.

(56) References Cited

U.S. PATENT DOCUMENTS

| | | | | | |
|---|---|---|---|---|---|
| 2,195,013 | A | | 3/1940 | Rastetter et al. | 248/223 |
| 2,608,369 | A | * | 8/1952 | Hocher | 248/201 |
| 2,678,086 | A | * | 5/1954 | Mohr | 297/240 |
| 2,750,142 | A | | 6/1956 | McKee | 248/216 |
| 3,142,501 | A | | 7/1964 | Clark et al. | 285/184 |
| 3,289,982 | A | * | 12/1966 | Hart, Jr. | 248/541 |
| 3,332,654 | A | * | 7/1967 | Jacobson | 211/107 |
| 3,385,545 | A | * | 5/1968 | Patton | 248/68.1 |
| 3,408,028 | A | * | 10/1968 | Raymond | 248/219.3 |
| 3,888,354 | A | * | 6/1975 | Margolin et al. | 211/110 |
| 3,950,874 | A | * | 4/1976 | Diggs | 40/607.12 |
| 4,156,272 | A | | 5/1979 | Wandler | 362/432 |
| 4,522,363 | A | | 6/1985 | Stuart | 248/225.2 |
| 5,405,113 | A | * | 4/1995 | Jaw | 248/229.1 |
| 5,653,365 | A | * | 8/1997 | Lee | 224/448 |
| 5,727,762 | A | * | 3/1998 | Cosentino | 248/231.61 |
| 5,975,727 | A | | 11/1999 | Morstein et al. | 362/431 |
| 6,155,701 | A | | 12/2000 | Leen | 362/432 |
| 6,547,197 | B2 | * | 4/2003 | Kempf et al. | 248/218.4 |
| 7,082,889 | B2 | * | 8/2006 | Clark | 116/174 |

* cited by examiner

*Primary Examiner*—Amy J. Sterling
(74) *Attorney, Agent, or Firm*—Dennis L. Thomte; Thomte Patent Law Office LLC

(57) ABSTRACT

A mounting bracket for attaching a luminaire support arm to a support pole. In one embodiment, the mounting bracket includes a hook, which is secured to the support pole, and a bracket, which is attachable to the hook. In a second embodiment, the bracket is secured to the support pole without the use of the hook. In both embodiments, the support arm is selectively vertically and rotatably received by the bracket.

17 Claims, 5 Drawing Sheets

MOUNTING BRACKET ASSEMBLY

BACKGROUND OF THE INVENTION

1. Field of the Invention

This invention relates to a mounting bracket assembly and more particularly to a mounting bracket assembly for attaching a luminaire support arm or pipe to a support pole with the support pole being comprised of wood, concrete, metal or composite/fiberglass.

2. Description of the Related Art

Streetlights or luminaires are usually mounted at the end of a support arm or support pipe which is attached at its other end to a support pole by a mounting bracket. If the support pole is wood, the mounting bracket must be screwed or bolted to the support pole. Frequently, the support pipe and mounting bracket are welded together at the factory which requires that both the support pole and mounting bracket be lifted to the upper end of the pole for attachment thereto. The fact that the support pipe and mounting bracket are of welded construction severely detracts from the vertical and angular adjustability of the support pipe with respect to the mounting bracket. Additionally, the conventional mounting brackets are of a welded construction which may result in the bracket having a heat affected zone around the weld which may result in lowering the fatigue resistance of the bracket.

SUMMARY OF THE INVENTION

A mounting bracket assembly of non-welded construction is described for attaching a luminaire support arm or pipe to a wood, concrete, metal or composite/fiberglass support pole which has a through bolt opening formed therein. The bracket assembly includes a support hook which is attached to the support pole at the desired location. The support hook includes: (a) a first upstanding side wall; (b) a second upstanding side wall horizontally spaced from the first side wall; (c) a third wall extending between the first and second side walls adjacent the inner ends thereof with the third wall having a bolt opening formed therein; (d) a first hook portion extending upwardly from the upper end of the first side wall adjacent the outer end thereof; (e) a second hook portion extending upwardly from the upper end of the second side wall adjacent the outer end thereof with a through bolt extending through the bolt opening in the third wall and through the through bolt opening in the pole to secure the support hook to the pole.

The mounting bracket assembly also includes a bracket comprising: (a) a first upstanding side wall; (b) a second upstanding side wall horizontally spaced from the first side wall; and (c) an upstanding, semi-cylindrical tubular portion at the outer ends of the first and second side walls with the first and second side walls having upper and lower bolt openings formed therein. The inner surface of the tubular portion is provided with ribs which are spaced 15° apart. An upper bolt extends through the upper bolt openings in the first and second side walls of the bracket and a lower bolt extends through the lower bolt openings in the first and second side walls of the bracket. The upper bolt is pivotally supported upon the upper ends of the first and second side walls of the hook inwardly of the hook portions with the lower bolt being positioned below the lower ends of the first and second side walls of the hook. The semi-cylindrical tubular portion is adapted to have an end of a luminaire or light support arm or pipe therein. The upper and lower bolts, upon being tightened, draw the first and second side walls of the bracket towards one another to cause the semi-cylindrical tubular portion and ribs to frictionally engage the support arm therein. The support arm is selectively vertically and rotatably adjustably mounted in the tubular portion.

The bracket further includes first and second upstanding flanges which extend laterally from the inner ends of the first and second side walls of the bracket, respectively, with lag bolts or screws extending through the flanges to secure the bracket to the pole.

It is therefore a principal object of the invention to provide an improved mounting bracket for attaching a luminaire support arm or pipe to a wood, concrete, metal or composite/fiberglass support pole.

A further object of the invention is to provide a mounting bracket assembly for attaching a luminaire support arm or pipe to a support pole wherein a support hook is first attached to the pole and a mounting bracket is then pivotally supported upon the support hook with the inner end of the support pipe then being inserted into the bracket and secured therein.

A further object of the invention is to provide a mounting bracket assembly for attaching a luminaire support arm or pipe to a support pole which enables the support arm to be more easily attached to the wood pole through the use of the mounting bracket assembly.

Yet another object of the invention is to provide a mounting bracket assembly for attaching a luminaire support arm or pipe to a support pole in such a manner that the support arm or pipe may be vertically adjusted with respect to the mounting bracket or may be radially adjusted with respect to the mounting bracket.

A further object of the invention is to provide a mounting bracket of non-welded construction which increases the design loads of the support arm and which greatly enhances the fatigue resistance of the bracket.

These and other objects will be apparent to those skilled in the art.

DETAILED DESCRIPTION OF THE INVENTION

Figures 1, 2:
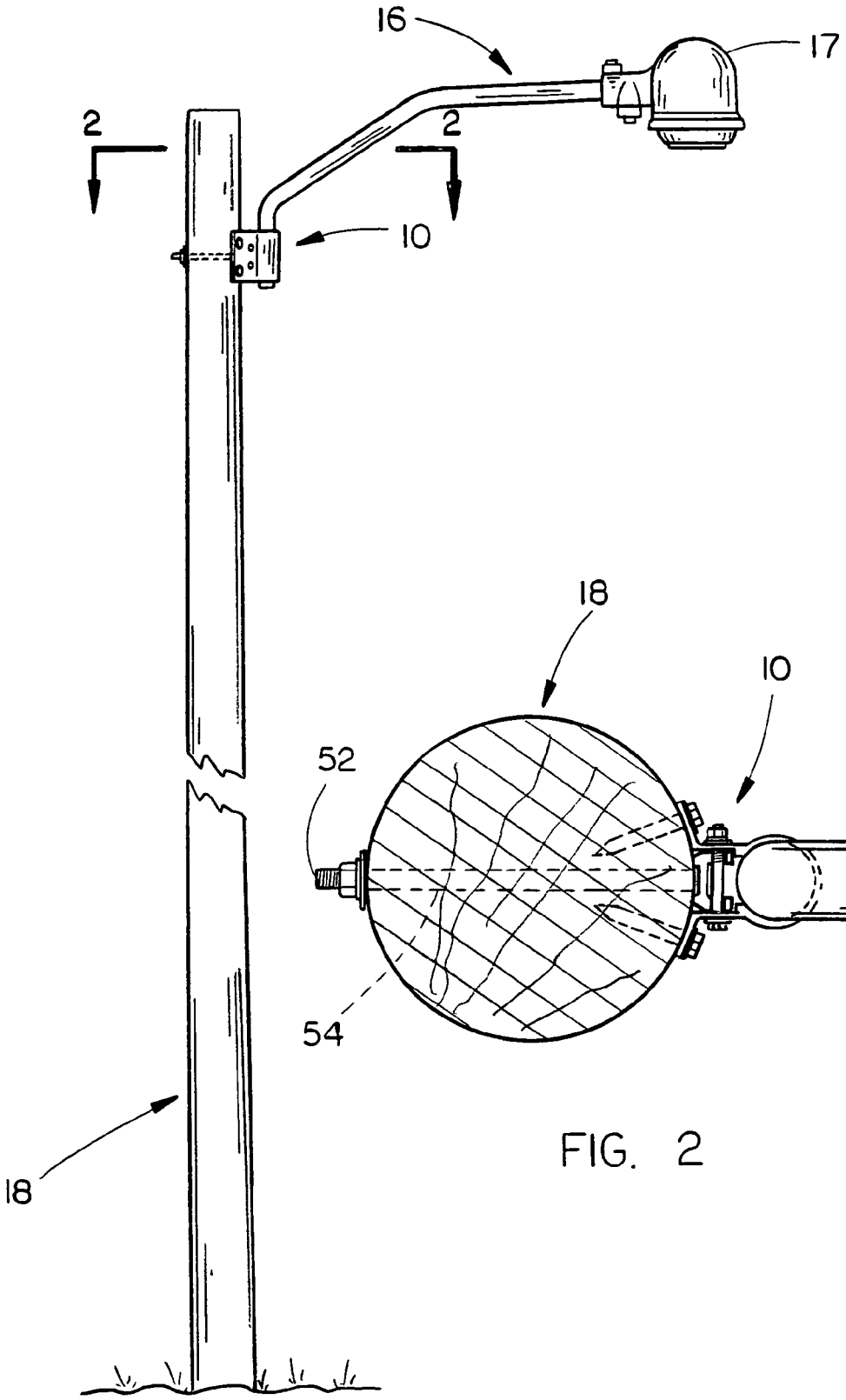
FIG. 1 is a partial side view of a wood support pole having the mounting bracket assembly of this invention mounted thereon and which supports a support pipe and luminaire.
FIG. 2 is an enlarged sectional view seen on lines 2-2 of FIG. 1.
Figure 3:
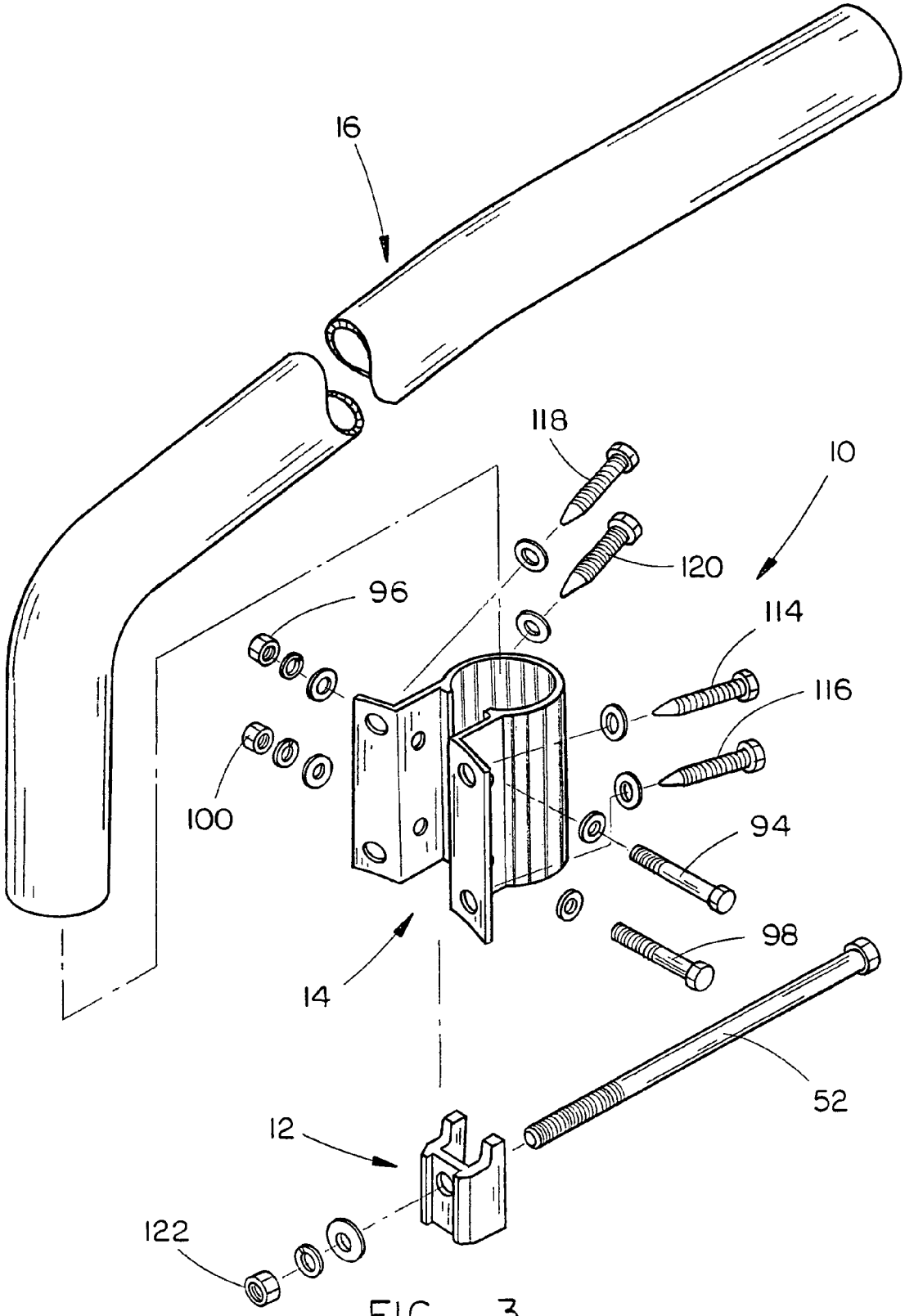
FIG. 3 is an exploded perspective view of the mounting bracket assembly of this invention and its relationship with respect to a support pipe.

The mounting bracket assembly of this invention is referred to generally by the reference numeral 10 and includes two basic parts, namely, a hook 12 and a bracket 14. The mounting bracket assembly of this invention is designed to support one end of a metal support arm or pipe 16 which normally will support a luminaire 17 at the other end thereof. The reference numeral 18 refers to a wood support pole have a cylindrical configuration. Although a wood support pole 18 is illustrated, the pole 18 may be constructed of concrete, composite/fiberglass or metal such as steel or aluminum.

Figure 4:
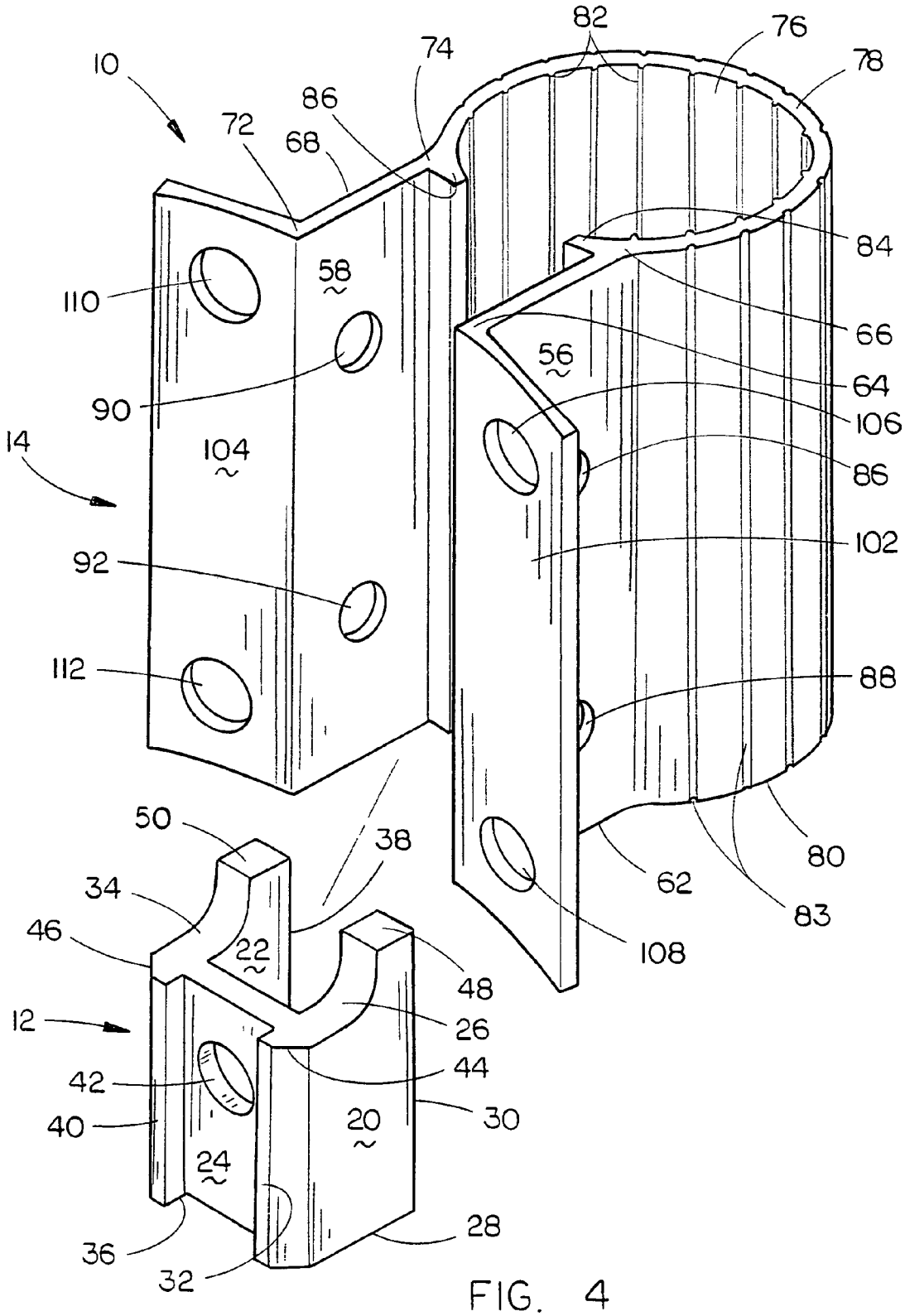
FIG. 4 is an exploded perspective view of the mounting bracket assembly of this invention.

Hook 12 includes upstanding side walls 20 and 22 and an end wall 24 extending therebetween outwardly of the inner ends thereof, as seen in FIG. 4. Preferably, hook 12 is comprised of an extruded aluminum material of one-piece construction. Side wall 20 includes an upper end 26, lower end 28, outer end 30 and inner end 32. Similarly, side wall 22 includes an upper end 34, lower end 36, outer end 38 and inner end 40. End wall 24 includes a bolt opening 42 extending therethrough. Preferably, the inner ends 32 and 40 of side walls 20 and 22 include tapered portions 44 and 46, as seen in FIG. 4, to form tooth-like portions which will be drawn into the exterior surface of the pole 18 as will be described hereinafter. An upstanding hook portion 48 extends upwardly from side wall 20 adjacent outer end 30. Similarly, hook portion 50 extends upwardly from side wall 22 adjacent outer end 38 thereof. Hook 12 is adapted to be secured to the pole 18 by means of a through bolt 52 which extends through bolt opening 42 and a through opening 54 formed or drilled in pole 18.

Bracket 14 is also preferably constructed of an extruded aluminum material so as to be of one-piece construction. Bracket 14 includes horizontally spaced-apart and vertically disposed side walls 56 and 58. For purposes of description, side wall 56 will be described as having an upper end 60 and a lower end 62. Also for purposes of description, side wall 56 will be described as having an inner end 64 and an outer end 66. Further, side wall 58 will be described as having an upper end 68, lower end 70, inner end 72 and outer end 74.

Bracket 14 includes a semi-cylindrical-shaped tubular portion 76 having an upper end 78 and a lower end 80. The interior surface of tubular portion 76 is preferably provided with spaced-apart ribs 82 which extend therefrom for gripping engagement with the end of the support arm 16. The ribs 82 are preferably spaced-apart 15°. Preferably, the ribs 82 coincide or register with index grooves 83 on the exterior surface of the tubular portion 76 to assist with the optional angular or radial orientation of the support arm 16 with respect to the bracket 14. Preferably, tubular portion 76 includes inwardly extending portions 84 and 86 so as to permit the tubular portion 76 to additionally extend around the circumference of the support arm 16.

Side wall 56 is provided with vertically spaced bolt openings 86 and 88 while side wall 58 is provided with vertically spaced bolt openings 90 and 92. An upper bolt 94 extends through bolt openings 90 and 86 and has a nut 96 mounted on one end thereof. Similarly, bolt 98 extends through bolt openings 92 and 88 and has a nut 100 mounted thereon.

Preferably, the bracket 14 also includes laterally extending flanges 102 and 104 which extend laterally from the inner ends 64 and 72 of side walls 56 and 58, respectively. Preferably, flange 102 is provided with spaced-apart openings 106 and 108 while flange 104 is provided with vertically spaced openings 110 and 112. Preferably, the horizontal cross section of the flanges 102 and 104 is slightly arcuate so as to conform to the exterior surface of the pole 18. Lag bolts or screws 114, 116, 118 and 120 may be extended through the bolt openings 106, 108, 110 and 112 to additionally secure the bracket 14 to the pole, as will be described hereinafter. In some cases only a single bolt opening will be provided in each of the flanges 102 and 104 dependent upon the wishes of the client. Further, even though the flanges 102 and 104 have a pair of bolt openings formed therein, in some cases only a single lag bolt will extend through each of the flanges.

Figure 6:
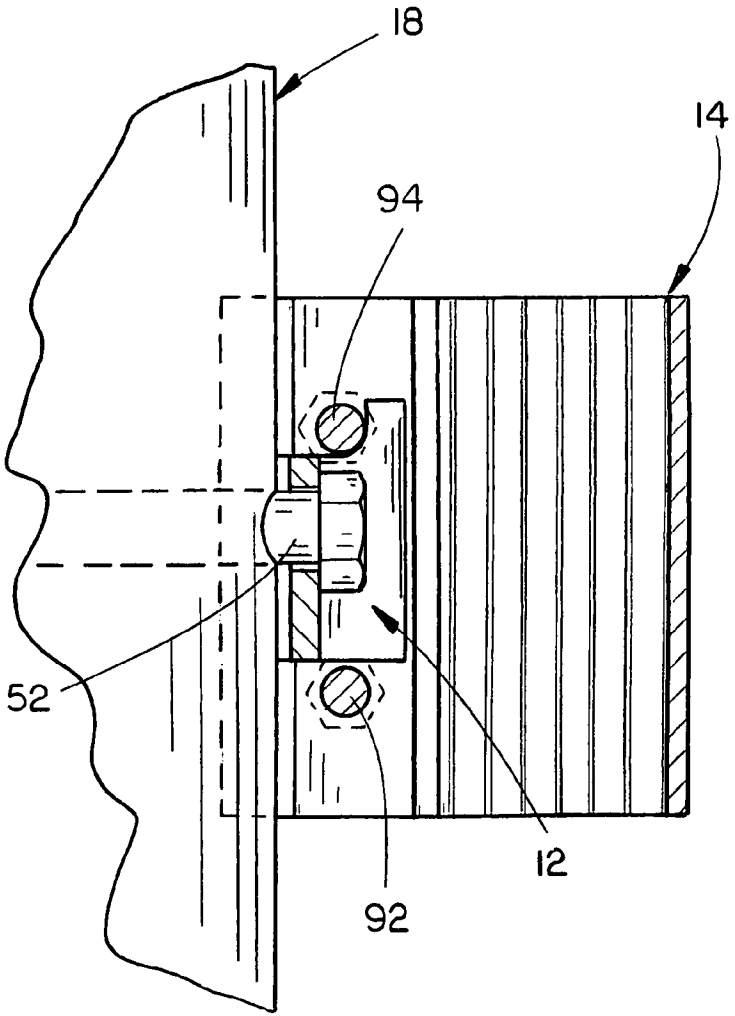
FIG. 6 is a view similar to FIG. 5 except that the mounting bracket has been positioned on the support hook.
Figure 5:
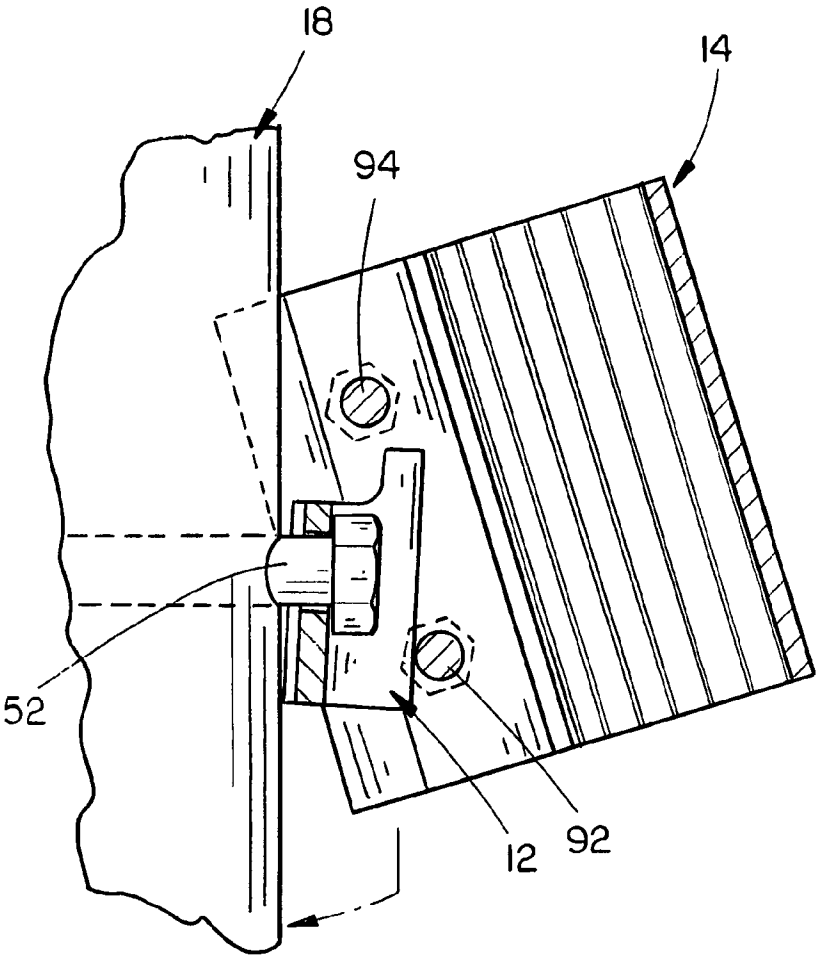
FIG. 5 is a cut away side view illustrating the manner in which the mounting bracket is secured to the support hook.
Figure 7:
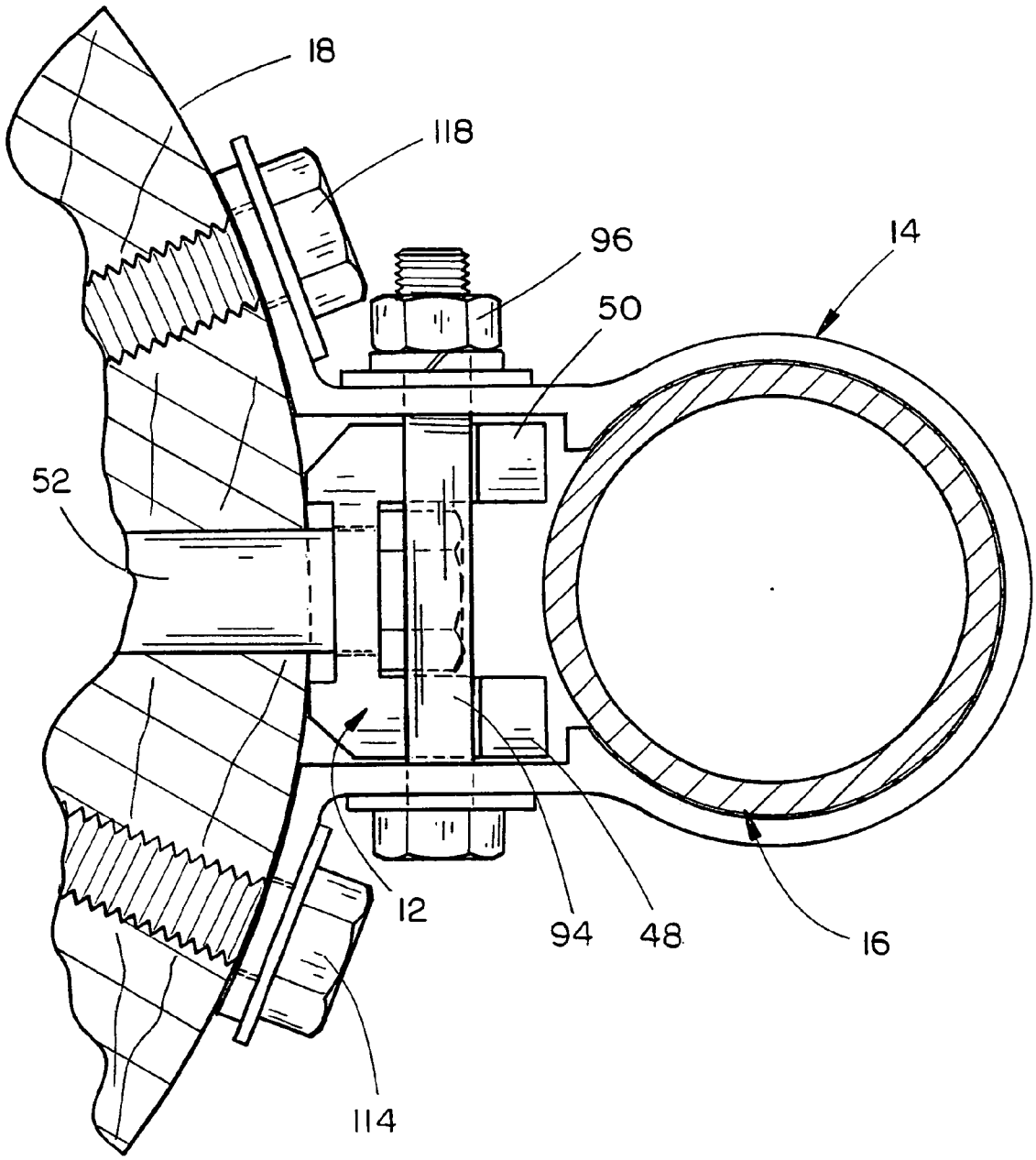
FIG. 7 is a partial sectional view illustrating the mounting bracket securing the support pipe to the support pole.

The mounting bracket assembly 10 is mounted on the pole 18 as will now be described. The through bolt 52 is extended through the bolt opening 42 of the hook 12 and the through bolt 52 is extended through the hole 54 in the pole 18. A nut 122 will be loosely threadably mounted on the threaded end of the bolt 52 so that the hook 12 may move slightly with respect to the pole 18 during the installation procedure. The bolts 92 and 94 will be extended through the bolt openings in the side walls 56 and 58, as previously described, but the nuts 96 and 100 thereon will not be tightened at this time. The bracket 14 is then maneuvered with respect to hook 12 (FIG. 5) so that the bolt 94 is positioned above the side walls 26 and 34 of hook 12 inwardly of the hook portions 48 and 50 with the side walls 56 and 58 of bracket 14 being positioned outwardly of side walls 26 and 34 of hook 12, respectively. The bracket 14 is then pivotally moved (FIG. 6) so that the lower bolt 92 is moved below the lower ends of the side walls 26 and 34. At this time, the nut on the through bolt 52 is tightened so that the tooth-like inner ends of side walls 20 and 22 are drawn into "biting" engagement with the exterior surface of the pole 18 so as to be partially embedded in the pole 18.

The end of the support arm 16 is the inserted downwardly into the tubular portion 76. At that time, when the support arm is positioned in the desired vertical position and the desired angular or radial position with respect to bracket 14, the nuts 96 and 100 are tightened which draws the side walls 56 and 58 of bracket 14 towards one another so that the tubular portion 76 closes around the support arm 16 with the ribs or teeth 82 being drawn into frictional engagement with the exterior surface of the support arm 16. When the support arm 16 has been firmly secured within the tubular portion 76, the lag bolts 114, 116, 118 and 120 are preferably extended through the openings 106, 108, 110 and 112, respectively, to draw the flanges 102 and 104 into engagement with the exterior surface of the pole 18. The use of the lag bolts 114, 116, 118 and 120 in the openings 106, 108, 110 and 112 prevents the bracket 14 from pivoting upwardly and outwardly with respect to the hook 12 which could cause disengagement of the bracket 14 from the hook 12. When the bolt 94 is resting upon the upper ends of the side walls 24 and 26 of hook 12, even before the lag bolts have been extended through the openings in the flanges, the positioning of the bolt 92 below the lower ends of the side walls 26 and 34 prevents the bracket 14 from moving upwardly with respect to the hook 12.

Thus it can be seen that a novel mounting bracket assembly has been provided to attach a support arm of a luminaire or the like to a wood pole. The mounting bracket assembly 10 permits the hook 12 to be first secured to the pole 18 with the bracket 14 then being attached thereto prior to the support arm being received within the bracket. The bracket assembly 10 permits the support arm 16 to be selectively vertically mounted within the bracket 14 and selectively radially mounted therein. Further, many different styles of support arms 16 may be used with the bracket 14. Additionally, brackets 14 having different diameter tubular portions 76 may be used with the hook 12. The mounting bracket assembly 10 permits the installation of support arms and luminaires onto a support pole in a much more convenient manner than heretofore possible.

The non-welded construction of the mounting bracket eliminates heat affected zones in the bracket which allows the increasing of the design loads on the support arm by at least 15% and greatly enhances the fatigue resistance of the bracket.

Thus it can be seen that the invention accomplishes at least all of its stated objectives.

I claim:

1. A mounting bracket assembly for attaching a luminaire support arm to a support pole having a through bolt opening formed therein, comprising:

a support hook for attachment to the support pole;

said support hook including:

(a) a first upstanding side wall having an upper end, a lower end, an inner end, and an outer end;

(b) a second upstanding side wall horizontally spaced from said first side wall and having an upper end, a lower end, an inner end, and an outer end;

(c) an end wall extending between said first and second side walls adjacent said inner ends thereof;

(d) said end wall having a bolt opening formed therein;

(e) a first hook portion extending upwardly from said upper end of said first side wall adjacent said outer end thereof;

(f) a second hook portion extending upwardly from said upper end of said second side wall adjacent said outer end thereof;

a through bolt extending through said bolt opening in said end wall and through the through belt opening in the pole to secure said support hook to the pole;

a bracket including:

(a) a first upstanding side wall having an upper end, a lower end, an inner end, and a outer end;

(b) a second upstanding side wall horizontally spaced from said first side wall of said bracket and having an upper end, a lower end, an inner end, and an outer end;

(c) an upstanding, semi-cylindrical tubular portion at the said outer ends of said first and second side walls of said bracket;

(d) each of said first and second side walls having upper and lower bolt openings formed therein;

(e) a first upstanding flange extending laterally from said inner end of said first side wall;

(f) a second upstanding flange extending laterally from said inner end of said second side wall;

an upper bolt extending through said upper bolt openings in said first and second side walls of said bracket;

a lower bolt extending through said lower bolt openings in said first and second side walls of said bracket;

said upper bolt being pivotally supported upon said upper ends of said first and second side walls of said hook inwardly of said hook portions;

said lower bolt being positioned below said lower ends of said first and second side walls of said hook;

said semi-cylindrical tubular portion adapted to have an end of the luminaire support arm received therein;

said upper and lower bolts, upon being tightened, drawing said first and second side walls of said bracket towards one another to cause said semi-cylindrical tubular portion to frictionally engage the support arm therein.

2. The assembly of claim 1 wherein said flanges have an arcuate cross section which generally conforms to the exterior of the pole.

3. The assembly of claim 1 wherein each of said flanges has at least one bolt opening formed therein.

4. The assembly of claim 1 wherein said semi-cylindrical tubular portion has a ribbed interior surface for gripping the support arm.

5. The assembly of claim 1 wherein said hook is of one-piece construction.

6. The assembly of claim 5 wherein said hook is comprised of extruded aluminum.

7. The assembly of claim 1 wherein said bracket is of one-piece construction.

8. The assembly of claim 7 wherein said bracket is comprised of extruded aluminum.

9. The assembly of claim 1 wherein said inner ends of said first and second side walls of said hook define horizontally spaced-apart and vertically disposed tooth-like portions extending therefrom for engagement with the pole.

10. The assembly of claim 1 wherein the interior surface of said semi-cylindrical tubular portion has a plurality of radially spaced-apart ribs for gripping the support arm.

11. The assembly of claim 1 wherein the exterior surface of said semi-cylindrical tubular portion has a plurality of radially spaced-apart grooves formed therein to assist in the angular orientation of the support arm with respect to the bracket.

12. The assembly of claim 11 wherein said grooves are spaced approximately 15° apart.

13. The assembly of claim 1 wherein said bracket is of non-welded construction.

14. The assembly of claim 1 wherein the support arm is selectively vertically and rotatably mounted in said tubular portion.

15. The assembly of claim 1 wherein the exterior surface of said semi-cylindrical tubular portion has a plurality of radially spaced-apart grooves formed therein to assist in the angular orientation of the support arm with respect to the bracket.

16. The assembly of claim 15 wherein said grooves are spaced approximately 15° apart.

17. The assembly of claim 1 wherein the support arm is selectively vertically and rotatably mounted in said tubular portion.

* * * * *